US010232485B2

(12) United States Patent
Xue et al.

(10) Patent No.: US 10,232,485 B2
(45) Date of Patent: Mar. 19, 2019

(54) WHEEL BURR REMOVING DEVICE

(71) Applicant: CITIC Dicastal CO.,LTD, Qinhuangdao (CN)

(72) Inventors: Bowen Xue, Qinhuangdao (CN); Haiping Chang, Qinhuangdao (CN); Ning Wang, Qinhuangdao (CN); Yongwang Zhao, Qinhuangdao (CN)

(73) Assignee: CITIC DICASTAL CO., LTD (CN)

( * ) Notice: Subject to any disclaimer, the term of this patent is extended or adjusted under 35 U.S.C. 154(b) by 62 days.

(21) Appl. No.: 15/423,644

(22) Filed: Feb. 3, 2017

(65) Prior Publication Data

US 2018/0147685 A1 May 31, 2018

(30) Foreign Application Priority Data

Nov. 26, 2016 (CN) ..... 2016 1 1057171

(51) Int. Cl.

| | |
|---|---|
| ***B24B 5/44*** | (2006.01) |
| ***B24B 9/00*** | (2006.01) |
| ***B24B 21/00*** | (2006.01) |
| ***B24B 27/00*** | (2006.01) |
| ***B24B 29/00*** | (2006.01) |
| ***B24B 41/06*** | (2012.01) |
| ***B24B 47/12*** | (2006.01) |
| ***B24B 9/04*** | (2006.01) |

(52) U.S. Cl.

CPC ..... *B24B 5/44* (2013.01); *B24B 9/00* (2013.01); *B24B 9/04* (2013.01); *B24B 21/006* (2013.01); *B24B 21/008* (2013.01); *B24B 27/0076* (2013.01); *B24B 29/005* (2013.01); *B24B 41/067* (2013.01); *B24B 47/12* (2013.01)

(58) Field of Classification Search

CPC ..... B24B 5/44; B24B 9/00; B24B 21/006; B24B 21/008; B24B 27/0076; B24B 29/005; B24B 41/067; B24B 47/12; B24B 9/04

USPC ..... 451/182, 194

See application file for complete search history.

(56) References Cited

U.S. PATENT DOCUMENTS 3,258,804 A * 7/1966 Fowle ..... B24B 5/225 15/104.011
5,890,952 A * 4/1999 Beaupre ..... B23Q 3/18 451/168
5,906,537 A * 5/1999 Elcock ..... B23C 3/30 451/194

(Continued)

FOREIGN PATENT DOCUMENTS

JP H 03294136 A * 12/1991
JP 3044289 B2 * 5/2000

*Primary Examiner* — Marc Carlson
(74) *Attorney, Agent, or Firm* — Calfee, Halter & Griswold LLP

(57) ABSTRACT

The present invention provides a wheel burr removing device, which includes a frame, cylinders, guide posts, brush systems I, brush systems II and a clamping rotating system. The device in the present invention not only can be used for adjusting the angles of brushes II according to the size and the shape of the wheel so as to focus on removing burrs at the root of the rim, but also can be used for specifically removing burrs at the roots of flanges and the middle parts of spokes; meanwhile, the device has the characteristics of high automation degree, advanced process, simple structure and high safety and stability.

2 Claims, 3 Drawing Sheets

(56) References Cited

U.S. PATENT DOCUMENTS

| | | | | |
|---|---|---|---|---|
| 6,217,424 | B1 * | 4/2001 | Stephens | B24B 5/44 451/254 |
| 6,722,961 | B2 * | 4/2004 | Solanellas | B23Q 1/54 451/140 |
| 9,724,796 | B2 * | 8/2017 | Xue | B24B 9/04 |
| 9,782,866 | B1 * | 10/2017 | Xue | B24B 9/04 |
| 2013/0102233 | A1 * | 4/2013 | Cheon | B24B 27/033 451/331 |
| 2016/0354891 | A1 * | 12/2016 | Xue | B24B 5/44 |

* cited by examiner

WHEEL BURR REMOVING DEVICE

CROSS-REFERENCE TO RELATED APPLICATIONS

This application claims priority to Chinese Patent Application No. 201611057171.3, filed on Nov. 26, 2016, which is hereby incorporated by reference in its entirety.

TECHNICAL FIELD

The present invention relates to a burr removing device, specifically to a device for removing burrs on the back cavity of a wheel.

BACKGROUND ART

In the aluminum alloy wheel production field, all enterprises face a very thorny problem about removing burrs after machining of back cavities. At present, burrs on the back cavity of a wheel are brushed with a large disc brush on special equipment, and this method is effective for gentle wheels but difficult in achieving the removal effect of meeting the requirements for use of most wheels; and when the method is used, corner burrs at the roots of flanges and the rim of the wheel always cannot be removed thoroughly, thereby influencing the following coating effect. Currently, there is no effective burr removing device capable of simultaneously disposing burrs at the roots of the flanges, the root of the rim and the back cavity of spokes.

SUMMARY OF THE INVENTION

The objective of the present invention is to provide a wheel burr removing device, which not only can be used for adjusting the angles of brushes II according to the size and the shape of a wheel so as to focus on removing burrs at the root of the rim, but also can be used for specifically removing burrs at the roots of flanges and the middle parts of spokes.

In order to fulfill the objective, the present invention adopts the technical solution: the device comprises a frame, cylinders, a bottom plate, guide posts, guide sleeves, a lifting plate, servo electric cylinders I, a guide rail I, servo electric cylinders II, a fixed rack I, guide rails II, slide plates, bearing seats I, shafts I, driving motors I, connecting plates, bearing seats II, shafts II, brushes I, servo motors I, guide rails III, fixed racks II, shafts III, turnover racks, belt pulleys I, synchronous belts I, belt pulleys II, belt pulleys III, brushes II, driving motors II, servo motors II, guide rails IV, platforms, sliding tables, servo electric cylinders III, rollers, belt pulleys IV, driving motors III, synchronous belts II, belt pulleys V and transition plates, wherein the two cylinders are fixed below the bottom plate; the four guide posts are fixed between the bottom plate and the platforms; the four guide sleeves matched with the guide posts are fixed on the lifting plate; and the output ends of the cylinders are articulated with the lower part of the lifting plate.

Each brush system I includes: the lower part of the fixed rack I is installed on the lifting plate via the guide rail I; a servo electric cylinder I is fixed on the lifting plate, and the output end of the servo electric cylinder I is connected with the fixed rack I; a slide plate is connected with the tops of two side plates of the fixed rack I via guide rails II; a bearing seat I is fixed on the left side of the slide plate, and a shaft I is installed inside the bearing seat I via a bearing; a servo motor I is fixed on the right side of the slide plate, and the output end of the servo motor I is connected with the right end of the shaft I; a connecting plate is connected with the left side of the shaft I; a bearing seat II is fixed on the connecting plate; a shaft II is installed inside the bearing seat II via a bearing; a driving motor I is fixed below the connecting plate, and the output end of the driving motor I is connected with the lower part of the shaft II; a brush I is fixed at the top of the shaft II; and the device includes two symmetrical brush systems I.

Each brush system II includes: the bottom surface of a fixed rack II is connected with the lateral surface of the fixed rack I via a guide rail III; the lower part of the fixed rack II is fixed on the lifting plate; the shafts III are fixed on two sides of a turnover rack, and are installed inside the fixed rack II via bearings; a servo motor II is fixed on one side of the fixed rack II, and the output end of the servo motor II is connected with the shafts III; a belt pulley I is fixed below the turnover rack; a belt pulley III is fixed at the top of the turnover rack; a transition plate is fixed in the middle of the turnover rack; a belt pulley II is installed below the transition plate; the output end of a driving motor II is connected with one side of the belt pulley II; the belt pulley I is connected with the belt pulley II by a synchronous belt I; the brushes II are installed outside the belt pulley I and the belt pulley III; and the device includes two symmetrical brush systems II.

Each clamping drive system includes: the bottom of a sliding table is installed above a platform via a guide rail IV; a servo electric cylinder III is fixed on one side of the bottom of the sliding table, and the output end of the servo electric cylinder III is connected with the frame; a belt pulley V is separately fixed at the tops of two rollers, and is installed inside the sliding table via a bearing; a driving motor HI is fixed at the top of the sliding table, and a belt pulley IV is installed at the output end of the driving motor III; the belt pulley IV is connected with the two belt pulleys V by a synchronous belt II; and the device includes a left clamping drive system and a right clamping drive system.

Bristles are arranged at the tops and in the circumferential directions of the brushes I; the brushes II are ribbon-shaped, and bristles are uniformly distributed on the outer sides of the brushes II and are arc-shaped.

In actual use, the clamping rotating system drives the wheel in a clamped state to rotate; the cylinders drive the lifting plate, the brush systems I and the brush systems II to rise via the guide posts and the guide sleeves; the servo motors I drive the brushes I to turn over via the shafts I, so that the bristle at the tops of the brushes I is upright; the driving motors I drive the brushes I to rotate via the shafts II, the servo electric cylinders II drive the brushes I to rise via the guide rails II, and burrs can be removed when the brushes I contact spokes on the back cavity of the wheel; the servo motors I drive the brushes I to rotate 90 degrees via the shafts I to remove burrs at the root of the flange; the servo electric cylinders I drive the brushes I to move left and right via the guide rail I, and the burrs on different spokes can be removed; the driving motors II drive the belt pulleys II to rotate, drive the belt pulleys I to rotate via the synchronous belts I, and drive the brushes II to rotate via the belt pulleys III; the angles of the turnover racks can be adjusted via the servo motors II, and after the brushes II contact corners at the root of the rim of the wheel by appropriate angles, burrs at the corners can be removed.

The device in the present invention not only can be used for adjusting the angles of brushes II according to the size and the shape of the wheel so as to focus on removing burrs at the root of the rim, but also can be used for specifically removing burrs at the roots of flanges and the middle parts of spokes; meanwhile, the device has the characteristics of high automation degree, advanced process, simple structure and high safety and stability.

Figure 1:
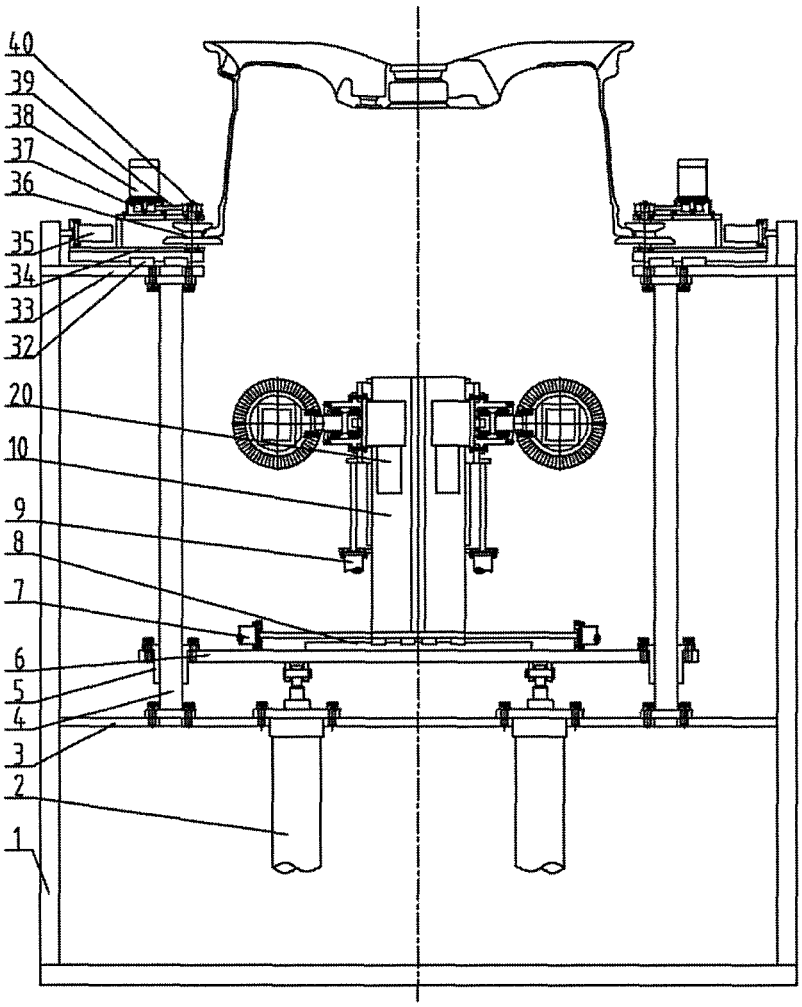
FIG. 1 is a front view of a wheel burr removing device of the present invention.
Figure 2:
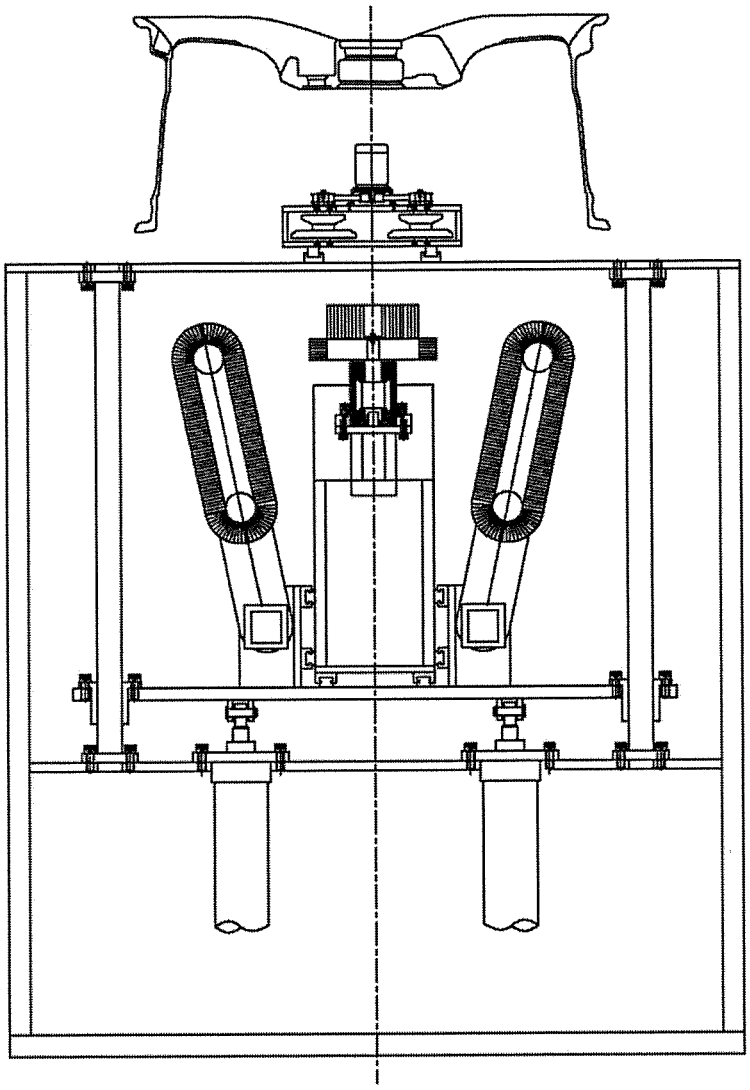
FIG. 2 is a left view of the wheel burr removing device of the present invention.
Figure 3:
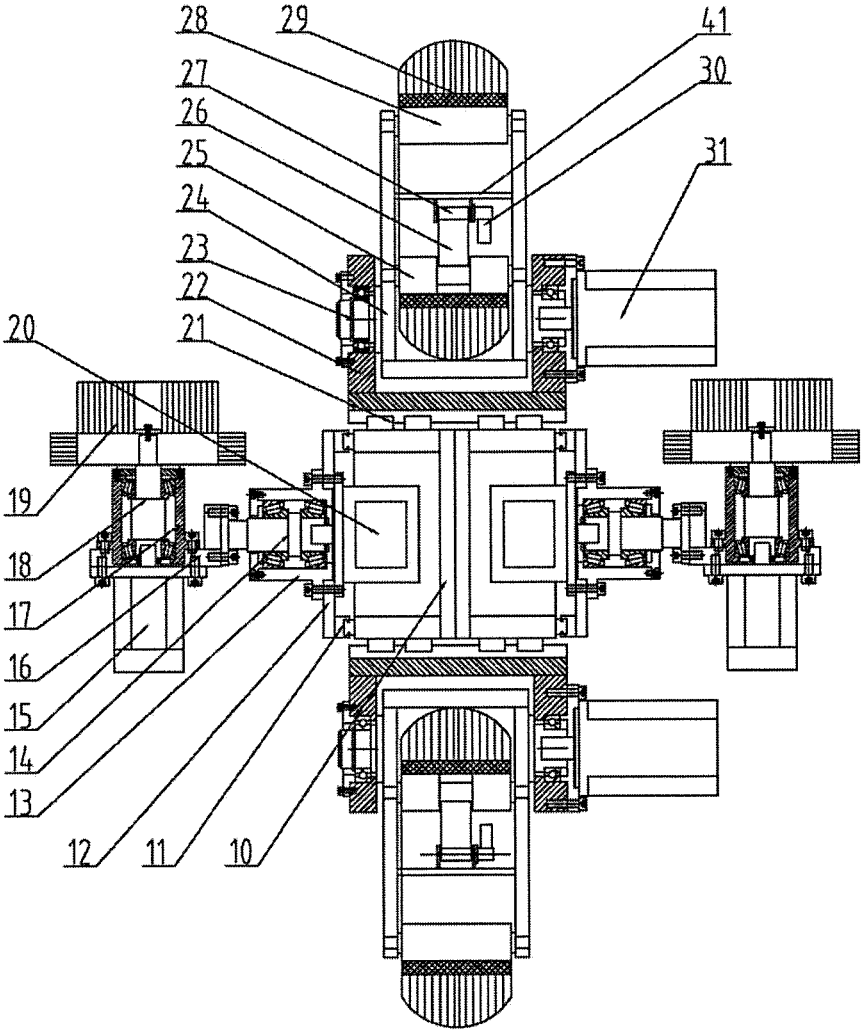
FIG. 3 is a partial top view of the wheel burr removing device of the present invention.

In figures: 1-frame, 2-cylinder, 3-bottom plate, 4-guide post, 5-guide sleeve, 6-lifting plate, 7-servo electric cylinder I, 8-guide rail I, 9-servo electric cylinder II, 10-fixed rack I, 11-guide rail II, 12-slide plate, 13-bearing seat I, 14-shaft I, 15-driving motor I, 16-connecting plate, 17-bearing seat II, 18-shaft II, 19-brush I, 20-servo motor I, 21-guide rail III, 22-fixed rack II, 23-shaft III, 24-turnover rack, 25-belt pulley I, 26-synchronous belt I, 27-belt pulley II, 28-belt pulley III, 29-brush II, 30-driving motor II, 31-servo motor II, 32-guide rail IV, 33-platform, 34-sliding table, 35-servo electric cylinder III, 36-roller, 37-belt pulley IV, 38-driving motor III, 39-synchronous belt II, 40-belt pulley V, 41-transition plate.

DETAILED DESCRIPTION OF THE INVENTION

Details and working conditions of a specific device provided by the present invention will be described below in combination with the accompanying drawings.

The device comprises a frame 1, cylinders 2, a bottom plate 3, guide posts 4, guide sleeves 5, a lifting plate 6, servo electric cylinders I 7, a guide rail I 8, servo electric cylinders II 9, a fixed rack I 10, guide rails II 11, slide plates 12, bearing seats I 13, shafts I 14, driving motors I 15, connecting plates 16, bearing seats II 17, shafts II 18, brushes I 19, servo motors I 20, guide rails III 21, fixed racks II 22, shafts III 23, turnover racks 24, belt pulleys I 25, synchronous belts I 26, belt pulleys II 27, belt pulleys III 28, brushes II 29, driving motors II 30, servo motors II 31, guide rails IV 32, platforms 33, sliding tables 34, servo electric cylinders III 35, rollers 36, belt pulleys IV 37, driving motors III 38, synchronous belts II 39, belt pulleys V 40 and transition plates 41, wherein the two cylinders 2 are fixed below the bottom plate 3; the four guide posts 4 are fixed between the bottom plate 3 and the platforms 33; the four guide sleeves 5 matched with the guide posts 4 are fixed on the lifting plate 6; and the output ends of the cylinders 2 are articulated with the lower part of the lifting plate 6.

Each brush system I includes: the lower part of the fixed rack I 10 is installed on the lifting plate 6 via the guide rail I 8; a servo electric cylinder I 7 is fixed on the lifting plate 6, and the output end of the servo electric cylinder I 7 is connected with the fixed rack I 10; a slide plate 12 is connected with the tops of two side plates of the fixed rack I 10 via guide rails II 11; a bearing seat I 13 is fixed on the left side of the slide plate 12, and a shaft I 14 is installed inside the bearing seat I 13 via a bearing; a servo motor I 20 is fixed on the right side of the slide plate 12, and the output end of the servo motor I 20 is connected with the right end of the shaft I 14; a connecting plate 16 is connected with the left side of the shaft 114; a bearing seat II 17 is fixed on the connecting plate 16; a shaft II 18 is installed inside the bearing seat II 17 via a bearing; a driving motor I 15 is fixed below the connecting plate 16, and the output end of the driving motor I 15 is connected with the lower part of the shaft II 18; a brush I 19 is fixed at the top of the shaft II 18; and the device includes two symmetrical brush systems I.

Each brush system II includes: the bottom surface of a fixed rack II 22 is connected with the lateral surface of the fixed rack I 10 via a guide rail III 21; the lower part of the fixed rack II 22 is fixed on the lifting plate 6; the shafts III 23 are fixed on two sides of a turnover rack 24, and are installed inside the fixed rack II 22 via bearings; a servo motor II 31 is fixed on one side of the fixed rack II 22, and the output end of the servo motor II 31 is connected with the shafts III 23; a belt pulley 25 is fixed below the turnover rack 24; a belt pulley III 28 is fixed at the top of the turnover rack 24; a transition plate 41 is fixed in the middle of the turnover rack 24; a belt pulley II 27 is installed below the transition plate 41; the output end of a driving motor II 30 is connected with one side of the belt pulley II 27; the belt pulley I 25 is connected with the belt pulley II 27 by a synchronous belt I 26; the brushes II 29 are installed outside the belt pulley I 25 and the belt pulley III 28; and the device includes two symmetrical brush systems II.

Each clamping drive system includes: the bottom of a sliding table 34 is installed above a platform 33 via a guide rail IV 32; a servo electric cylinder III 35 is fixed on one side of the bottom of the sliding table 34, and the output end of the servo electric cylinder III 35 is connected with the frame 1; a belt pulley V 40 is separately fixed at the tops of two rollers 36, and is installed inside the sliding table 34 via a bearing; a driving motor III 38 is fixed at the top of the sliding table 34, and a belt pulley IV 37 is installed at the output end of the driving motor III 38; the belt pulley IV 37 is connected with the two belt pulleys V 40 by a synchronous belt II 39; and the device includes a left clamping drive system and a right clamping drive system.

Bristles are arranged at the tops and in the circumferential directions of the brushes I 19; the brushes II 29 are ribbon-shaped, and arc-shaped bristles are uniformly distributed on the outer sides of the brushes II 29.

In the working process, the clamping rotating system drives the wheel in a clamped state to rotate; the cylinders 2 drive the lifting plate 6, the brush systems I and the brush systems II to rise via the guide posts 4 and the guide sleeves 5; the servo motors I 20 drive the brushes I 19 to turn over via the shafts I 14, so that the bristle at the tops of the brushes I 19 is upright; the driving motors I 15 drive the brushes I 19 to rotate via the shafts II 18, the servo electric cylinders II 9 drive the brushes I 19 to rise via the guide rails II 11, and burrs can be removed when the brushes I 19 contact spokes on the back cavity of the wheel; the servo motors I 20 drive the brushes I 19 to rotate 90 degrees via the shafts I 14 to remove burrs at the root of the flange; the servo electric cylinders I 7 drive the brushes I 19 to move left and right via the guide rail I 8, and the burrs on different spokes can be removed; the driving motors II 30 drive the belt pulleys II 27 to rotate, drive the belt pulleys I 25 to rotate via the synchronous belts I 26, and drive the brushes II 29 to rotate via the belt pulleys III 28; the angles of the turnover racks 24 can be adjusted via the servo motors II 31, and after the brushes II 29 contact corners at the root of the rim of the wheel by appropriate angles, burrs at the corners can be removed.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A wheel rim burr removing device, comprising a frame, two cylinders, a bottom plate, four guide posts, four guide sleeves, a lifting plate, servo electric cylinders I, a guide rail I, servo electric cylinders II, a fixed rack I, guide rails II, slide plates, bearing seats I, shafts I, driving motors I, connecting plates, bearing seats II, shafts II, brushes I, servo motors I, guide rails III, fixed racks II, shafts III, turnover racks, belt pulleys I, synchronous belts I, belt pulleys II, belt pulleys III, brushes II, driving motors II, servo motors II, guide rails IV, platforms, sliding tables, servo electric cylinders III, two rollers, belt pulleys IV, driving motors III, synchronous belts II, belt pulleys V and transition plates, wherein the two cylinders are fixed below the bottom plate; the four guide posts are fixed between the bottom plate and the platforms; the four guide sleeves matched with the four guide posts are fixed on the lifting plate; and output ends of the two cylinders are articulated with a lower part of the lifting plate;

a brush system I comprises: a lower part of the fixed rack I installed on the lifting plate via the guide rail I; each of the servo electric cylinders I is fixed on the lifting plate, and an output end of each of the servo electric cylinders I is connected with the fixed rack I; the slide plates are connected with tops of two side plates of the fixed rack I via the guide rails II; each of the bearing seats I is fixed on a left side of each of the slide plates, and each of the shafts I is installed inside each of the bearing seats I via a bearing; each of the servo motors I is fixed on a right side of each of the slide plates, and an output end of each of the servo motors I is connected with a right end of each of the shafts I; each of the connecting plates is connected with a left side of each of the shafts I; each of the bearing seats II is fixed on each of the connecting plates; each of the shafts II is installed inside each of the bearing seats II via a bearing; each of the driving motors I is fixed below each of the connecting plates, and an output end of each of the driving motors I is connected with a lower part of each of the shafts II; the brush I is fixed at a top of each of the shafts II; and the device comprises two symmetrical brush systems I;

a brush system II comprises: a bottom surface of each of the fixed racks II connected with a lateral surface of the fixed rack I via each of the guide rails III; a lower part of each of the fixed racks II is fixed on the lifting plate; the shafts III are fixed on two sides of the turnover racks, and are installed inside the fixed racks II via bearings; each of the servo motors II is fixed on one side of each of the fixed racks II, and an output end of each of the servo motors II is connected with each of the shafts III; each of the belt pulleys I is fixed below each of the turnover racks; each of the belt pulleys III is fixed at a top of each of the turnover racks; each of the transition plates is fixed in a middle of each of the turnover racks; each of the belt pulleys II is installed below each of the transition plates; an output end of each of the driving motors II is connected with one side of each of the belt pulleys II; each of the belt pulleys I is connected with each of the belt pulleys II by each of the synchronous belts I; the brushes II are installed outside the belt pulleys I and the belt pulleys III; and the device comprises two symmetrical brush systems II;

a clamping drive system comprises: a bottom of each of the sliding tables is installed above each of the platform via each of the guide rails IV; each of the servo electric cylinders III is fixed on one side of a bottom of each of the sliding tables, and an output end of each of the servo electric cylinders III is connected with the frame; each of the belt pulleys V is fixed at a top of each of the two rollers, and is installed inside each of the sliding tables via a bearing; each of the driving motors III is fixed at a top of each of the sliding tables, and each of the belt pulleys IV is installed at an output end of each of the driving motors III; each of the belt pulleys IV is connected with each of the two belt pulleys V by each of the synchronous belts II; and the device comprises a left clamping drive system and a right clamping drive system;

in actual use, the clamping drive system drives the wheel in a clamped state to rotate; the two cylinders drive the lifting plate, the brush systems I and the brush systems II to rise via the four guide posts and the four guide sleeves; the servo motors I drive the brushes I to turn over via the shafts I, so that the bristle bristles at the tops of the brushes I are upright; the driving motors I drive the brushes Ito rotate via the shafts II, the servo electric cylinders II drive the brushes Ito rise via the guide rails II, and burrs can be removed when the brushes I contact spokes on the back cavity of the wheel; the servo motors I drive the brushes Ito rotate 90 degrees via the shafts I to remove burrs at a root of a flange of the wheel rim; the servo electric cylinders I drive the brushes Ito move left and right via the guide rails I, and the burrs on different spokes can be removed; the driving motors II drive the belt pulleys II to rotate, drive the belt pulleys I to rotate via the synchronous belts I, and drive the brushes II to rotate via the belt pulleys III; the angles of the turnover racks can be adjusted via the servo motors II, and after the brushes II contact corners at the root of the wheel rim of the by appropriate angles to remove burrs at the corners.

2. The wheel burr removing device of claim 1, wherein bristles are arranged at tops and in circumferential directions of the brushes I; the brushes II are ribbon-shaped, and bristles are uniformly distributed on the outer sides of the brushes II and are arc-shaped.

* * * * *